US009091961B2

(12) United States Patent
Iketani

(10) Patent No.: US 9,091,961 B2
(45) Date of Patent: Jul. 28, 2015

(54) TONER CONTAINER AND IMAGE FORMING APPARATUS PROVIDED WITH THE TONER CONTAINER

(71) Applicant: KYOCERA Document Solutions Inc., Osaka (JP)

(72) Inventor: Takeshi Iketani, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/147,711

(22) Filed: Jan. 6, 2014

(65) Prior Publication Data

US 2014/0193178 A1 Jul. 10, 2014

(30) Foreign Application Priority Data

Jan. 9, 2013 (JP) ..... 2013-001542

(51) Int. Cl.
*G03G 15/08* (2006.01)

(52) U.S. Cl.
CPC ..... *G03G 15/087* (2013.01); *G03G 15/0831* (2013.01)

(58) Field of Classification Search
CPC ..... G03G 15/0831; G03G 15/0894
USPC ..... 399/263
See application file for complete search history.

(56) References Cited

U.S. PATENT DOCUMENTS 6,385,422 B1 * 5/2002 Ishiguro et al. ..... 399/258
2009/0196633 A1 8/2009 Morimoto
2012/0201560 A1 * 8/2012 Nichols et al. ..... 399/75

FOREIGN PATENT DOCUMENTS

JP 2008203677 A * 9/2008
JP 2009-186597 8/2009

* cited by examiner

*Primary Examiner* — Clayton E LaBalle
*Assistant Examiner* — Leon W Rhodes, Jr.
(74) *Attorney, Agent, or Firm* — Wenderoth, Lind & Ponack, L.L.P.

(57) ABSTRACT

A movable member installed in a bottom portion of a housing is configured such that, if the amount of a toner existing within the housing is equal to or larger than a predetermined amount, the movable member lies down in a lying-down position where the movable member extends along an inner wall surface of the bottom portion of the housing and, if the amount of the toner existing within the housing is less than the predetermined amount, the movable member moves from the lying-down position to a protruding position where at least a portion of the movable member protrudes from the inner wall surface of the bottom portion of the housing. A stirring sheet is configured such that, if the stirring sheet moves in a state that an engaging portion engages with the movable member, the base end portion of the stirring sheet is detached from the shaft.

4 Claims, 13 Drawing Sheets

TONER CONTAINER AND IMAGE FORMING APPARATUS PROVIDED WITH THE TONER CONTAINER

CROSS-REFERENCE TO RELATED APPLICATION(S)

This application is based upon and claims the benefit of priority from Japanese Patent Application(s) No. 2013-001542 filed on Jan. 9, 2013, the entire contents of which are incorporated herein by reference.

BACKGROUND

The technology of the present disclosure relates to a toner container and an image forming apparatus provided with the toner container.

An image forming apparatus such as a laser printer or the like is provided with, e.g., a toner container mounted to an apparatus body. An image forming unit including, e.g., a developing unit, is installed in the apparatus body.

The toner container includes a housing that retains a toner as a developing agent. The housing is usually made of a resin or the like. A toner supply unit for supplying the toner to the developing unit of the apparatus body is installed in the housing. A screw unit for conveying the toner to the toner supply unit and a stirring mechanism are installed within the housing.

The toner retained within the housing is stirred by the stirring mechanism and is conveyed to the screw unit. The toner conveyed to the screw unit is conveyed to the toner supply unit by the rotating screw unit. Then, the toner is supplied from the toner supply unit to the developing unit existing outside the housing.

The toner container is removably mounted to the apparatus body. If the toner held within the toner container is reduced and used up by the operation of the image forming apparatus, the used toner container is removed from the apparatus body. Thereafter, a new toner container filled with a toner is mounted to the apparatus body. This enables the image forming apparatus to continuously perform an image forming operation.

SUMMARY

A toner container according to one aspect of the present disclosure includes a housing, a toner supply unit and a stirring mechanism. A toner is retained within the housing. The toner supply unit is installed in the housing and is configured to supply the toner to the outside. The stirring mechanism is configured to stir the toner within the housing such that the toner is conveyed to the toner supply unit.

The stirring mechanism includes a shaft and a stirring sheet. The shaft is rotationally driven within the housing. The stirring sheet has a base end portion removably mounted to the shaft and a tip end portion configured to move while making contact with at least an inner wall surface of a bottom portion of the housing during rotation of the shaft. A movable member is installed in the bottom portion of the housing.

The movable member is configured such that, if the amount of the toner existing within the housing is equal to or larger than a predetermined amount, the movable member lies down in a lying-down position where the movable member extends along the inner wall surface of the bottom portion of the housing and, if the amount of the toner existing within the housing is less than the predetermined amount, the movable member moves from the lying-down position to a protruding position where at least a portion of the movable member protrudes from the inner wall surface of the bottom portion of the housing.

The stirring sheet includes an engaging portion that engages with the movable member moved to the protruding position. The stirring sheet is configured such that, if the stirring sheet moves in a state that the engaging portion engages with the movable member, the base end portion of the stirring sheet is detached from the shaft.

An image forming apparatus according to another aspect of the present disclosure is provided with the toner container.

DETAILED DESCRIPTION

An embodiment of the present disclosure will now be described with reference to the accompanying drawings.

Embodiment

Laser Printer

Figure 1:
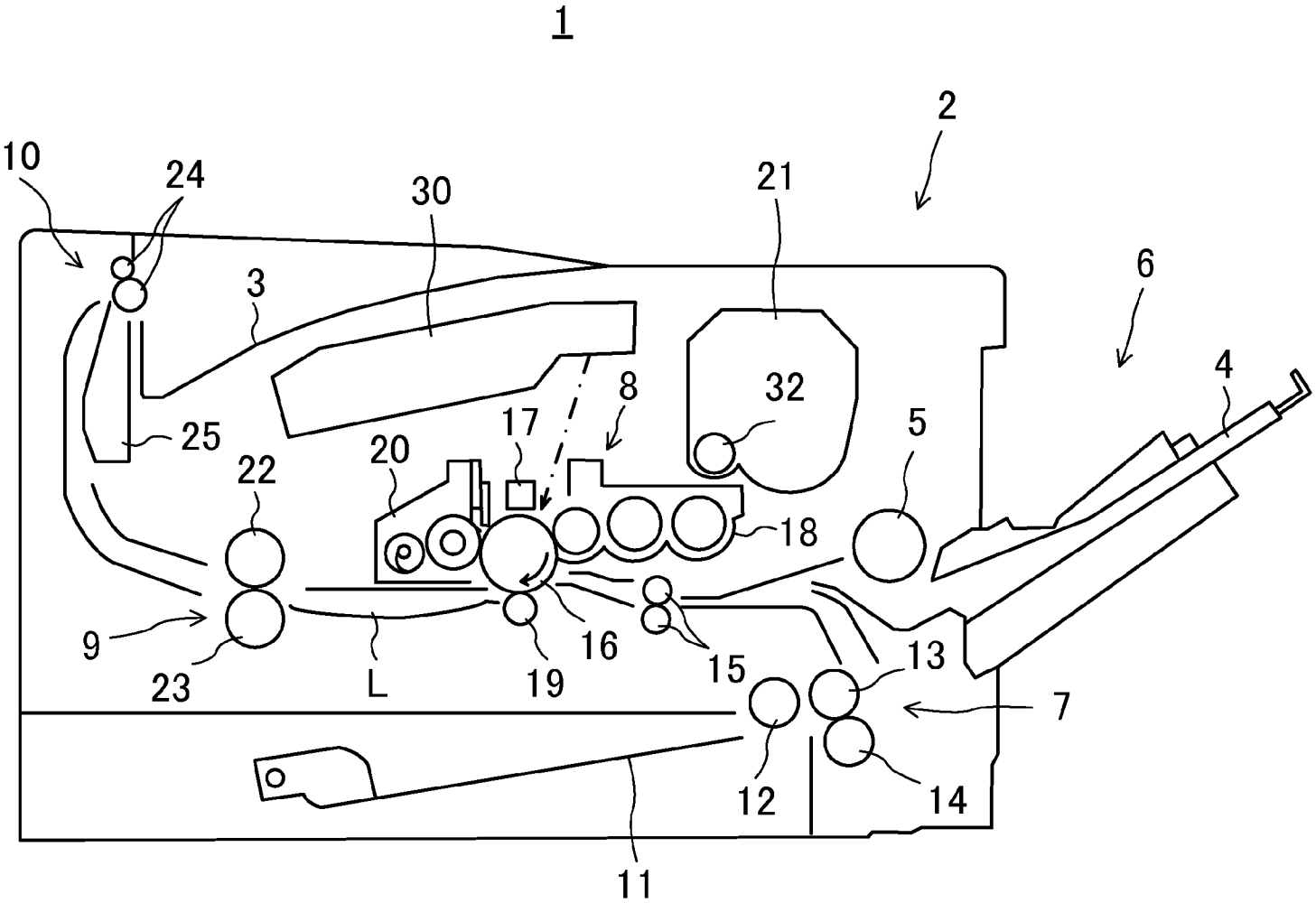
FIG. 1 is a sectional view showing a schematic configuration of an image forming apparatus according to an embodiment of the present disclosure.

FIG. 1 is a sectional view showing a schematic configuration of a laser printer 1 as an image forming apparatus according to an embodiment of the present disclosure.

As shown in FIG. 1, the laser printer 1 includes an apparatus body 2 and a toner container 21 removably mounted to the apparatus body 2.

The apparatus body 2 includes a manual paper feeding unit 6, a cassette paper feeding unit 7, an image forming unit 8, a fixing unit 9 and a paper discharge unit 10. The laser printer 1 is configured to, while conveying a paper along a conveying path L within the apparatus body 2, form an image on the paper based on image data transmitted from a terminal not shown.

The manual paper feeding unit 6 includes a manual feeding tray 4 and a paper feeding roller 5. The manual feeding tray 4 is installed in one side portion of the apparatus body 2 so that it can be opened and closed. The paper feeding roller 5 is a manual feeding roller rotatably installed within the apparatus body 2.

The cassette paper feeding unit 7 is installed in a bottom portion of the apparatus body 2. The cassette paper feeding unit 7 includes a paper feeding cassette 11, a pickup roller 12, a feed roller 13 and a retard roller 14. The paper feeding cassette 11 retains a plurality of papers overlapping with each one another. The pickup roller 12 takes out one by one the papers retained within the paper feeding cassette 11. The feed roller 13 and the retard roller 14 separate one by one the papers taken out by the pickup roller 12 and send the papers to the conveying path L.

The image forming unit 8 is installed above the cassette paper feeding unit 7 within the apparatus body 2. The image forming unit 8 includes a photosensitive drum 16, an electrifier 17, a developing unit 18, a transfer roller 19, a cleaning unit 20 and a laser scanner unit 30. The photosensitive drum 16 is an image carrier rotatably installed within the apparatus body 2. The electrifier 17, the developing unit 18, the transfer roller 19 and the cleaning unit 20 are disposed around the photosensitive drum 16. The laser scanner unit 30 serves as an optical scanner. The laser scanner unit (LSU) 30 is arranged above the photosensitive drum 16. A toner is supplied from the toner container 21 to the developing unit 18. Thus, the image forming unit 8 forms an image on the paper supplied from the manual paper feeding unit 6 or the cassette paper feeding unit 7.

Installed in the conveying path L is a pair of register rollers 15 that temporarily keeps the sent paper on standby and supplies the paper to the image forming unit 8 at a predetermined timing.

The fixing unit 9 is disposed at one side of the image forming unit 8. The fixing unit 9 includes a fixing roller 22 and a pressing roller 23. The fixing roller 22 and the pressing roller 23 are configured to rotate in a state that they are pressed against each other. Thus, the fixing unit 9 is configured to fix a toner image, which is transferred to the paper in the image forming unit 8, to the paper.

The paper discharge unit 10 is installed above the fixing unit 9. The paper discharge unit 10 includes a paper discharge tray 3, a pair of paper discharge rollers 24 and a plurality of conveyance guide ribs 25. The paper discharge rollers 24 convey the paper toward the paper discharge tray 3. The conveyance guide ribs 25 guide the paper toward the paper discharge rollers 24. The paper discharge tray 3 is formed into a concave shape in the upper portion of the apparatus body 2.

If the laser printer 1 receives image data, the photosensitive drum 16 of the image forming unit 8 is rotationally driven and the electrifier 17 electrifies the surface of the photosensitive drum 16.

Based on the image data, laser light is emitted from the laser scanner unit 30 toward the photosensitive drum 16. By the irradiation of the laser light, an electrostatic latent image is formed on the surface of the photosensitive drum 16. In the meantime, a toner is supplied from the toner container 21 to the developing unit 18. The electrostatic latent image formed on the photosensitive drum 16 is developed by the developing unit 18 and is visualized as a toner image.

Thereafter, the paper is pressed against the surface of the photosensitive drum 16 by the transfer roller 19. Thus, the toner image of the photosensitive drum 16 is transferred to the paper. The paper to which the toner image is transferred is heated and pressed by the fixing roller 22 and the pressing roller 23 of the fixing unit 9. As a result, the toner image is fixed to the paper.

<Toner Container>

Figure 2:
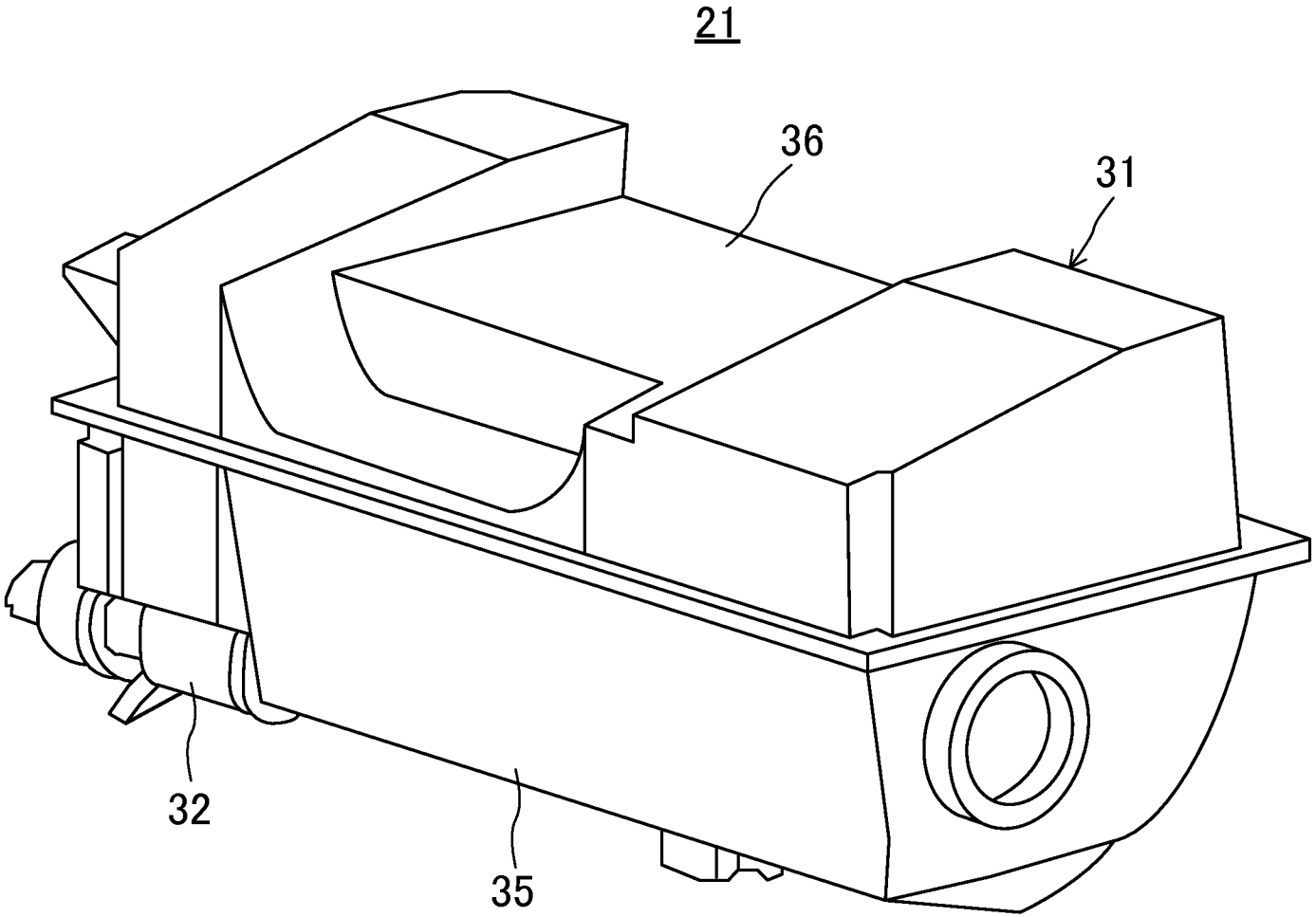
FIG. 2 is a perspective view showing an outward appearance of a toner container according to an embodiment of the present disclosure.
Figure 3:
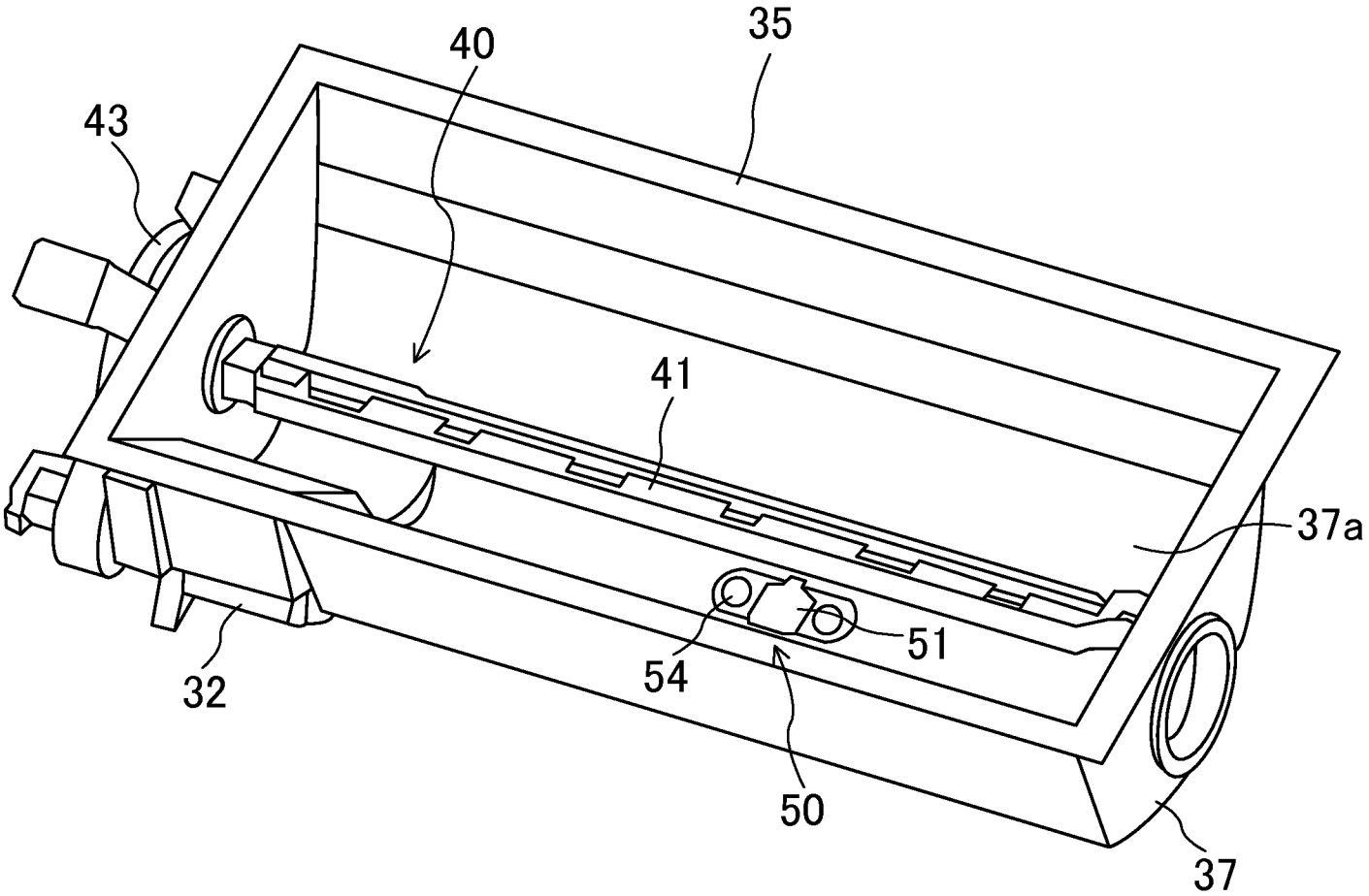
FIG. 3 is a perspective view showing an outward appearance of a container body.
Figure 4:
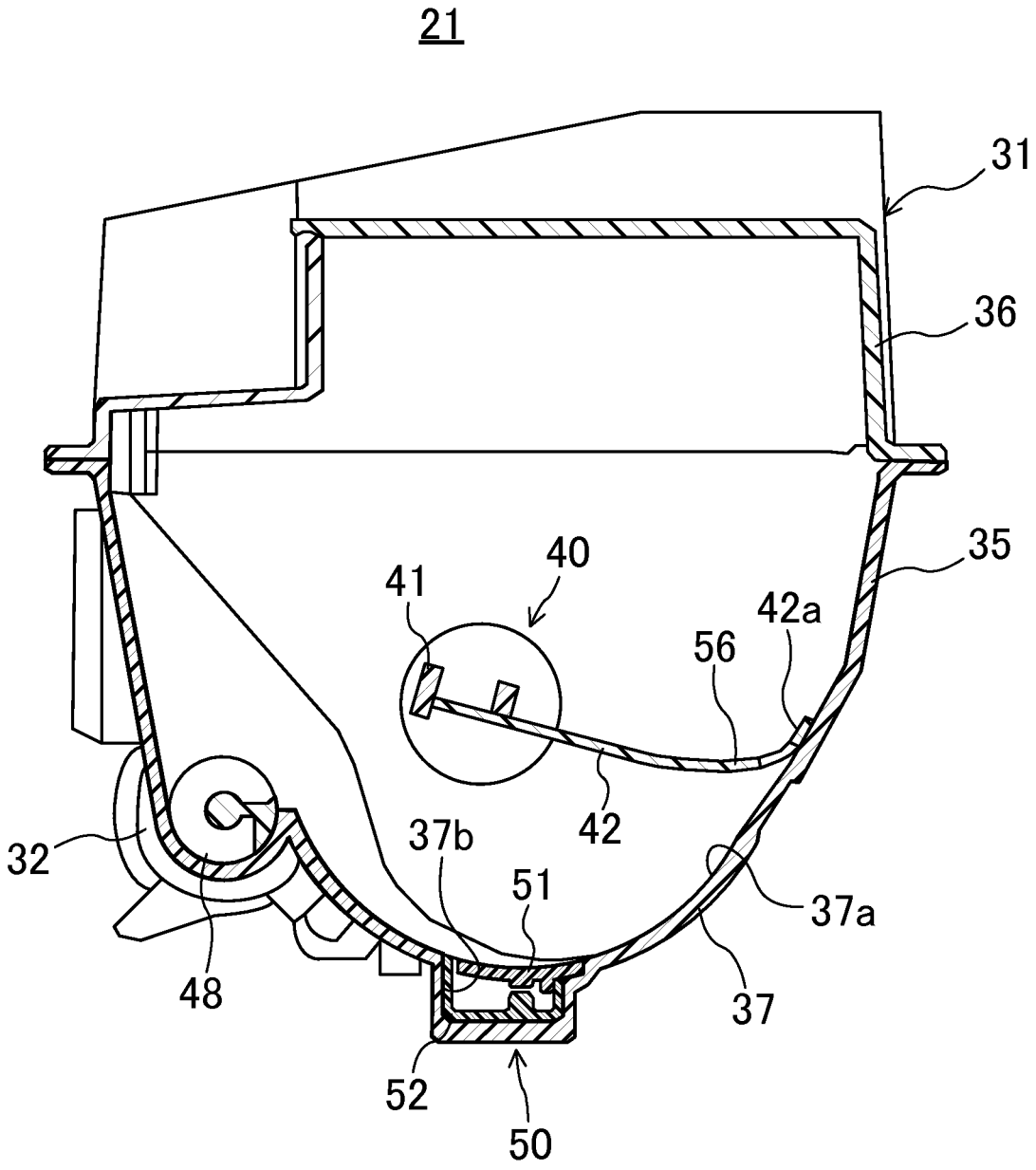
FIG. 4 is a sectional view showing a vertical cross section of the toner container.

FIG. 2 is a perspective view showing the outward appearance of the toner container 21 according to an embodiment of the present disclosure. FIG. 3 is a perspective view showing the outward appearance of the container body 35. FIG. 4 is a sectional view showing the vertical cross section of the toner container 21.

The toner container 21 is disposed above the image forming unit 8. As shown in FIGS. 2 to 4, the toner container 21 includes a housing 31, a toner supply unit 32 and a stirring mechanism 40. The housing 31 is mounted to the apparatus body 2 and is configured to retain a toner. The toner supply unit 32 is installed in the housing 31 and is configured to supply the toner to the apparatus body 2. The stirring mechanism 40 stirs the toner within the housing 31 so that the toner can be conveyed to the toner supply unit 32.

The housing 31 includes a container body 35 and a cover 36. The container body 35 is provided with a bottom and is opened in the upper portion thereof. The cover 36 closes the open portion of the container body 35. As shown in FIG. 4, the container body 35 includes a bottom portion 37. The bottom portion 37 is provided with an inner wall surface 37*a* having an arc-like cross-sectional shape.

Figure 5:
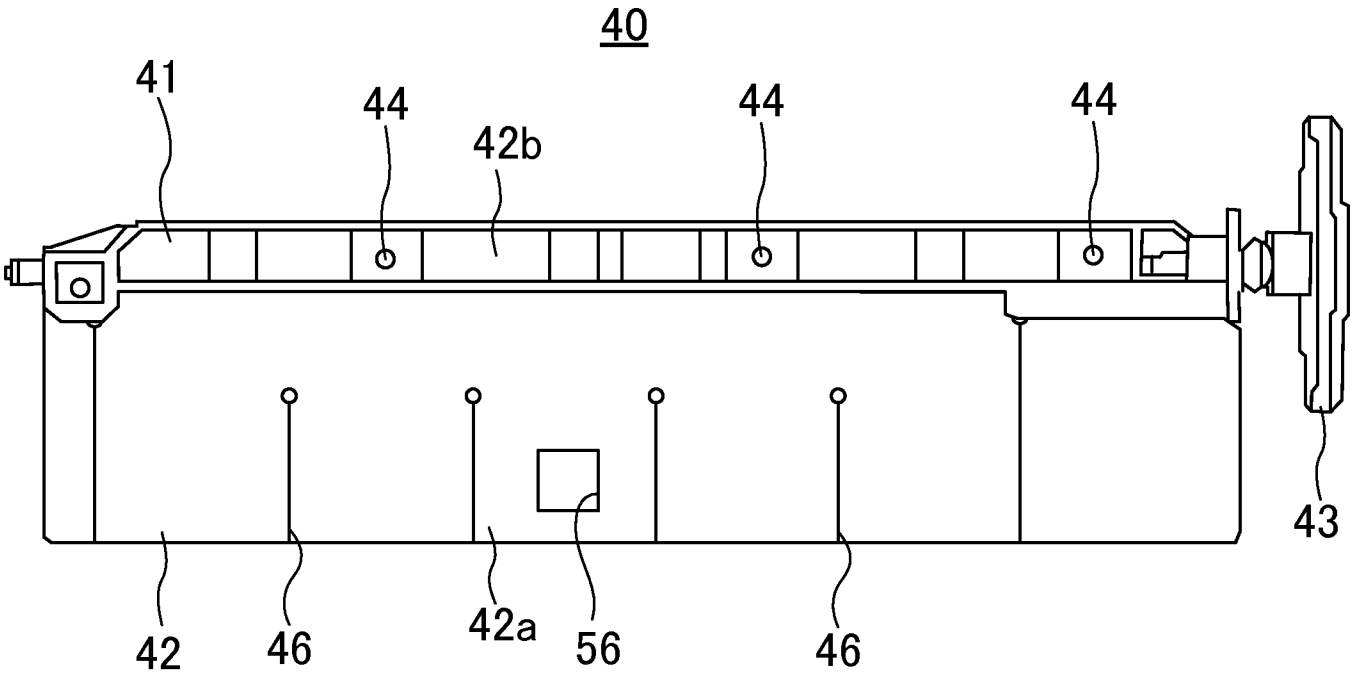
FIG. 5 is a plan view showing an outward appearance of a stirring mechanism.

FIG. 5 is a plan view showing the outward appearance of the stirring mechanism 40. As shown in FIG. 3, the stirring mechanism 40 is mounted to the container body 35. The stirring mechanism 40 includes a shaft 41 and a stirring sheet 42. The shaft 41 is rotationally driven within the housing 31. The stirring sheet 42 is attached to the shaft 41.

The shaft 41 extends within the housing 31. The inner wall surface 37*a* having an arc-like cross-sectional shape extends along the axial direction of the shaft 41. One end of the shaft 41 is connected to a driving pulley 43 arranged outside the container body 35. Thus, the shaft 41 is configured to be rotationally driven.

The stirring sheet 42 is formed of an elastic sheet member. The stirring sheet 42 is formed by, e.g., a plastic film. A plurality of slits 46 is formed in the stirring sheet 42. The slits 46 extend from a tip end portion 42*a* of the stirring sheet 42 toward a base end portion 42*b* thereof.

The shaft 41 is required to have rigidity but the stirring sheet 42 is required to have elasticity. Therefore, the shaft 41 and the stirring sheet 42 are formed by different materials. It is preferred that the shaft 41 is formed by, e.g., a glass-mixed resin or a metallic core member covered with a resin. On the other hand, it is preferred that the stirring sheet 42 is formed by, e.g., a thermoplastic sheet made of urethane rubber or the like, or a PET film.

Figure 6:
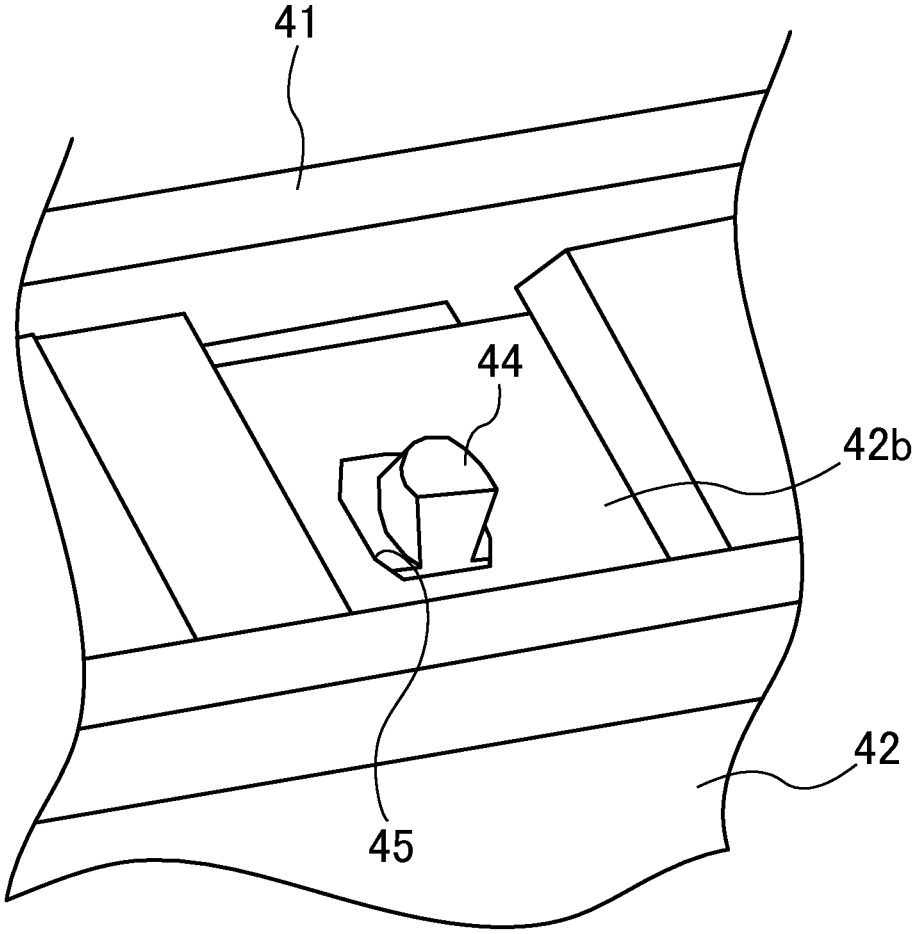
FIG. 6 is a partially enlarged perspective view showing a shaft.

The base end portion 42*b* of the stirring sheet 42 is removably mounted to the shaft 41. FIG. 6 is a partially enlarged perspective view showing the shaft 41. As shown in FIGS. 5 and 6, the shaft 41 has a plurality of projections 44 disposed at a predetermined interval along the axial direction thereof. The stirring sheet 42 has a plurality of hole portions 45 formed in a corresponding relationship with the respective projections 44. The hole portions 45 engage with the projections 44, whereby the stirring sheet 42 is attached to the shaft 41.

As shown in FIG. 4, during rotation of the shaft 41, the tip end portion 42*a* of the stirring sheet 42 moves while making contact with at least the inner wall surface 37*a* of the bottom portion 37 of the housing 31. Thus, the toner retained within the housing 31 is stirred by the stirring sheet 42 that rotates together with the shaft 41.

A screw 48 extending in the axial direction of the shaft is installed within the housing 31. The screw 48 is arranged more upward than the lowermost position of the bottom portion 37 of the housing 31. The screw 48 is configured to, when rotated, convey the toner toward one side in the axial direction of the screw 48. A toner discharge port as the toner supply unit 32 and a shutter are installed in the portion of the container body 35 to which the toner is conveyed by the screw 48.

Thus, upon rotationally driving the shaft 41 of the stirring mechanism 40, the stirring sheet 42 rotates while making contact with the inner wall surface 37*a* of the bottom portion 37 of the container body 35. Consequently, the toner existing in the bottom portion 37 of the housing 31 is stirred and raked up toward the screw 48 by the stirring sheet 42. Subsequently, the toner is conveyed toward the toner supply unit 32 by the rotating screw 48. The toner arriving at the toner supply unit 32 is supplied to the outside, e.g., the developing unit 18 of the apparatus body 2 of the laser printer 1.

AS shown in FIGS. 3 and 4, a stopper mechanism 50 is installed in the bottom portion 37 of the housing 31 of the toner container 21. The stopper mechanism 50 detaches the stirring sheet 42 from the shaft 41 when the toner container 21 is used up.

Figure 11:
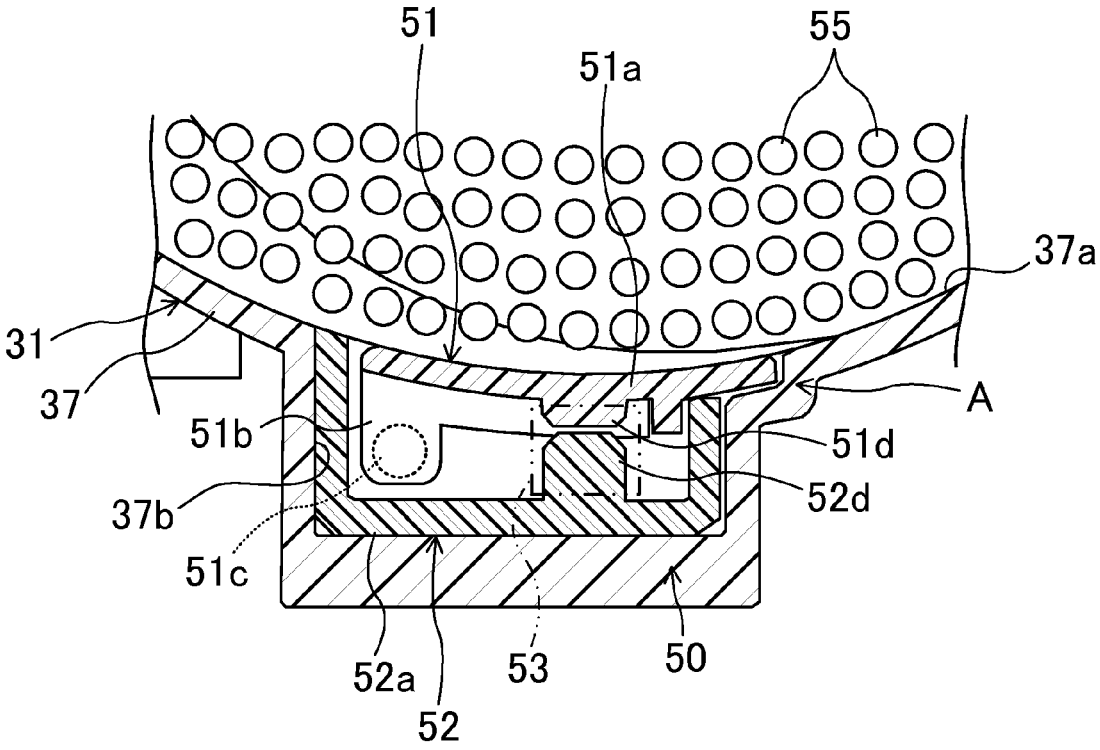
FIG. 11 is a sectional view showing the stopper mechanism when the amount of the toner existing within a housing is equal to or larger than a predetermined amount.
Figure 12:
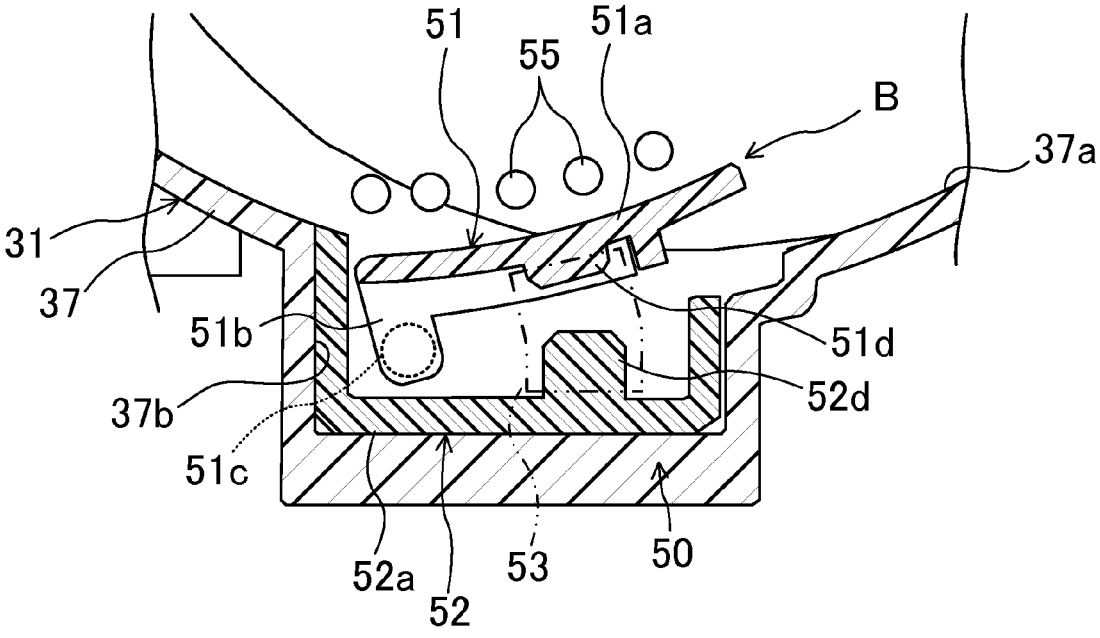
FIG. 12 is a sectional view showing the stopper mechanism when the amount of the toner existing within the housing is less than the predetermined amount.

FIGS. 7 to 10 are perspective views showing the configuration of the stopper mechanism 50. FIGS. 11 and 12 are enlarged sectional views illustrating the operation states of the stopper mechanism 50.

As shown in FIGS. 7 to 10, the stopper mechanism 50 includes a movable member 51, a support member 52 for supporting the movable member 51 and a biasing member 53 interposed between the movable member 51 and the support member 52.

The movable member 51 includes a plate-shaped body portion 51*a*. The body portion 51*a* has a surface extending along the inner wall surface 37*a* of the bottom portion 37 of the container body 35. The tip end of the body portion 51*a* is formed into a claw shape. A pair of brackets 51*b* is one-piece formed with the base end of the body portion 51*a*. Shafts 51*c* are one-piece formed with the brackets 51*b*, respectively. A lug 51*d* for locking the biasing member 53 is formed on the lower surface of the body portion 51*a*.

The support member 52 includes a box-shaped storage portion 52*a* opened in the upper portion thereof and brackets 52*b* extending to the left and right sides from the storage portion 52*a*. Through-holes 52*c* are formed in the mutually-opposing walls that define the storage portion 52*a*. A lug 52*d* for locking the biasing member 53 is formed in the bottom of the storage portion 52*a*.

The shafts 51*c* of the movable member 51 are inserted into the through-holes 52*c* of the storage portion 52*a*. Thus, the movable member 51 is supported by the support member 52 so as to swing about the axis of the shafts 51*c* (see FIGS. 8 and 9).

Figure 7:
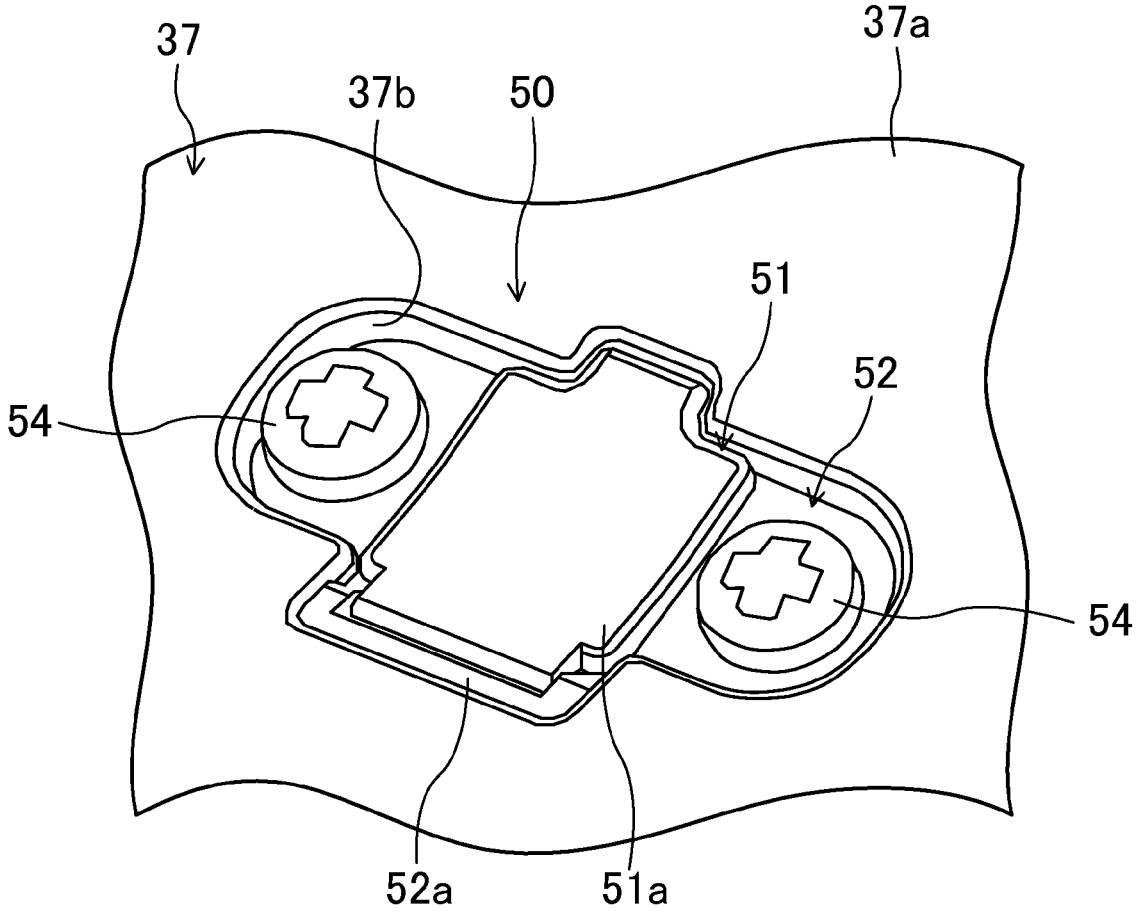
FIG. 7 is a perspective view showing a stopper mechanism attached to the toner body.
Figure 8:
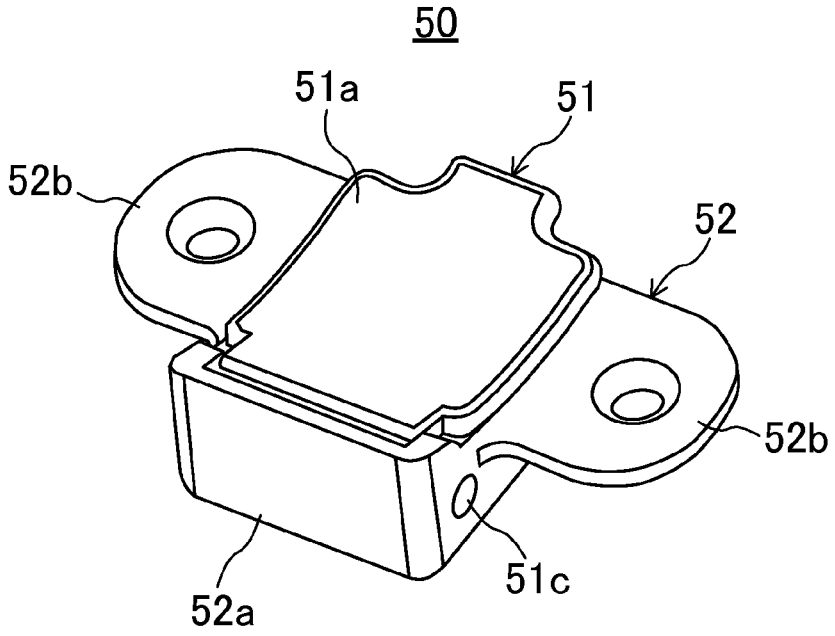
FIG. 8 is a perspective view showing the stopper mechanism in which a movable member lies down.
Figure 9:
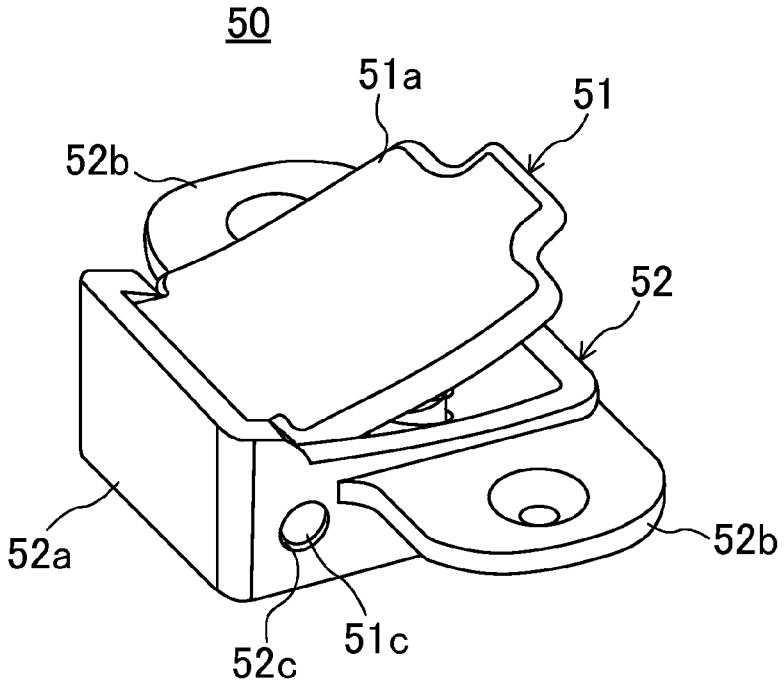
FIG. 9 is a perspective view showing the stopper mechanism in which the movable member protrudes out.
Figure 10:
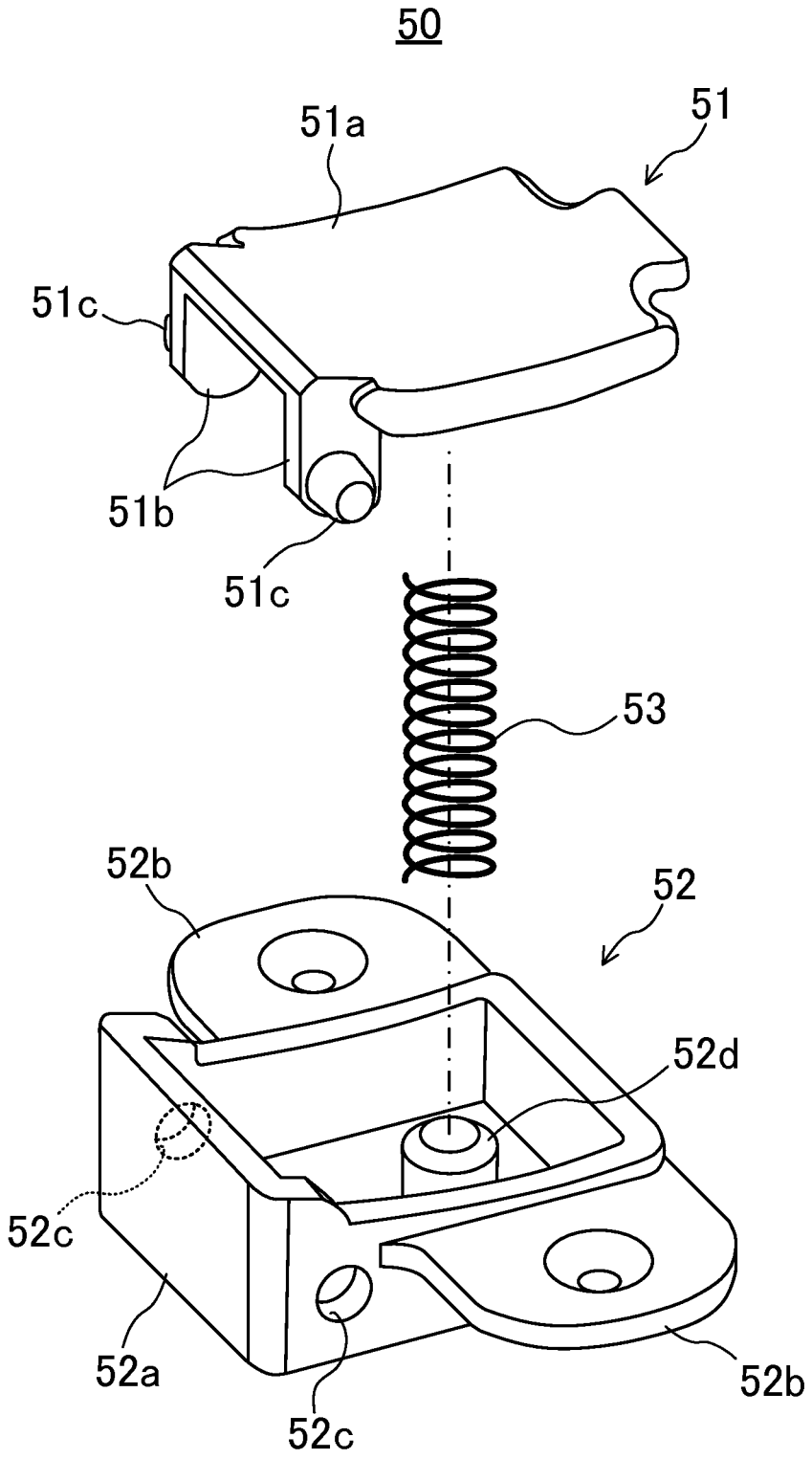
FIG. 10 is an exploded perspective view showing the configuration of the stopper mechanism.

The storage portion 52*a* is accommodated within a recess portion 37*b* formed in the bottom portion 37 of the container body 35. As shown in FIG. 7, the support member 52 is attached to the bottom portion 37 of the container body 35 by screws 54 penetrating the brackets 52*b*, in such a state that the storage portion 52*a* is accommodated within the recess portion 37*b*.

The biasing member 53 biases at least a portion of the movable member 51 so as to protrude from the inner wall surface 37*a* of the housing 31. Preferably, the biasing member 53 is a compressed resilient member. For example, a compression spring is suitable for use as the resilient member. If the biasing member 53 is, e.g., a compression spring, the biasing force of the biasing member 53 can be set to a desired magnitude by defining a spring constant.

As shown in FIG. 11, if the amount of the toner 55 existing within the housing 31 is equal to or larger than a predetermined amount and if the toner container 21 is in a usable state, the movable member 51 lies down in a lying-down position A. In the lying-down position A, due to the weight of the toner 55, the movable member 51 is arranged to extend along the inner wall surface 37*a* of the bottom portion 37 of the housing 31. When the movable member 51 is in the lying-down position A, the force applied to the movable member 51 by the weight of the toner 55 is larger than the biasing force of the biasing member 53.

As shown in FIG. 12, if the amount of the toner 55 existing within the housing 31 is less than the predetermined amount and if the toner container 21 is in a used-up state, the movable member 51 is moved from the lying-down position A to a protruding position B. In the protruding position B, at least a portion of the movable member 51, namely the tip end portion of the movable member 51, protrudes from the inner wall surface 37*a* of the bottom portion 37 of the housing 31. When the movable member 51 is in the protruding position B, the force applied to the movable member 51 by the weight of the toner 55 is smaller than the biasing force of the biasing member 53.

Figure 13:
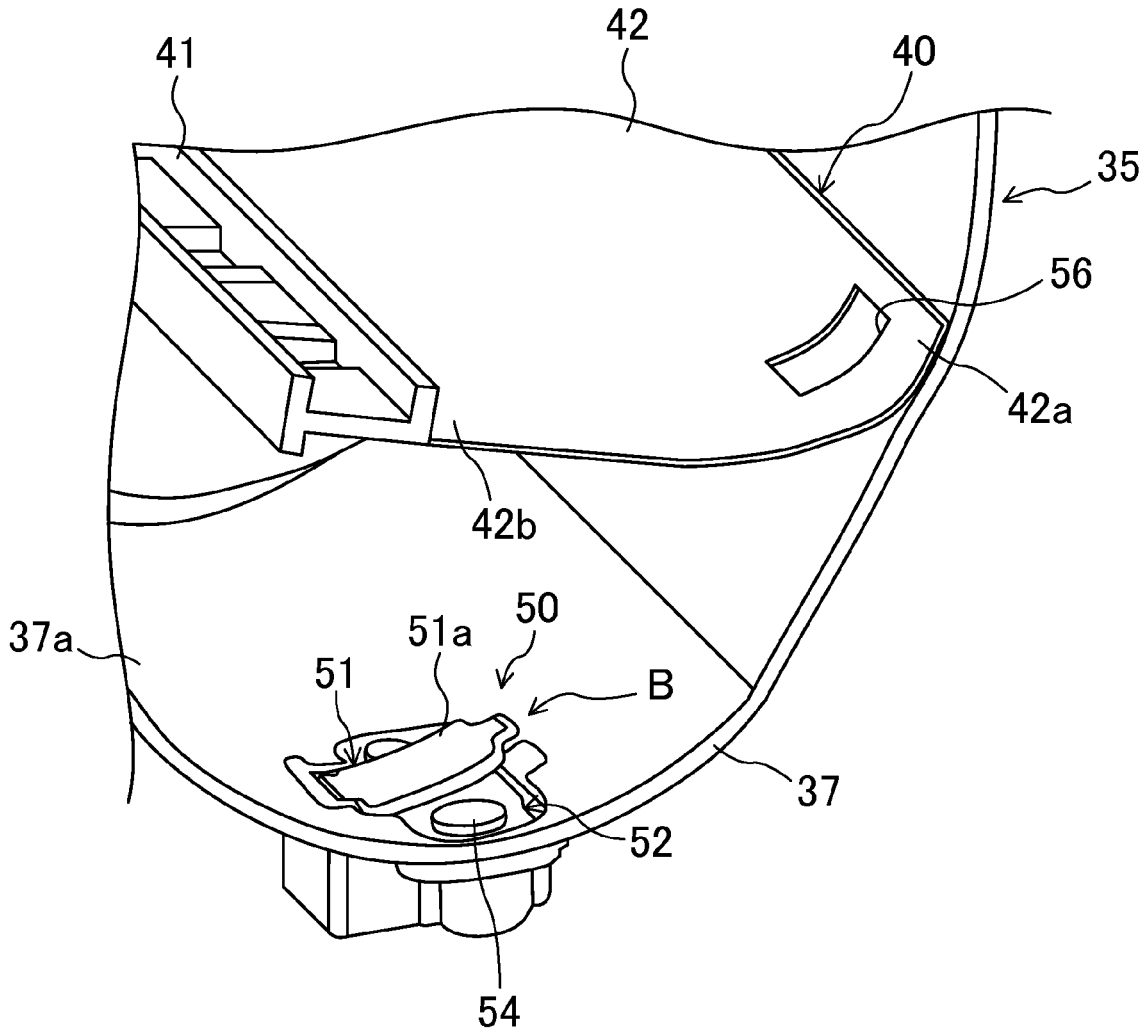
FIG. 13 is a partially cutaway perspective view showing the actuated stopper mechanism and a stirring sheet moving toward the stopper mechanism.
Figure 14:
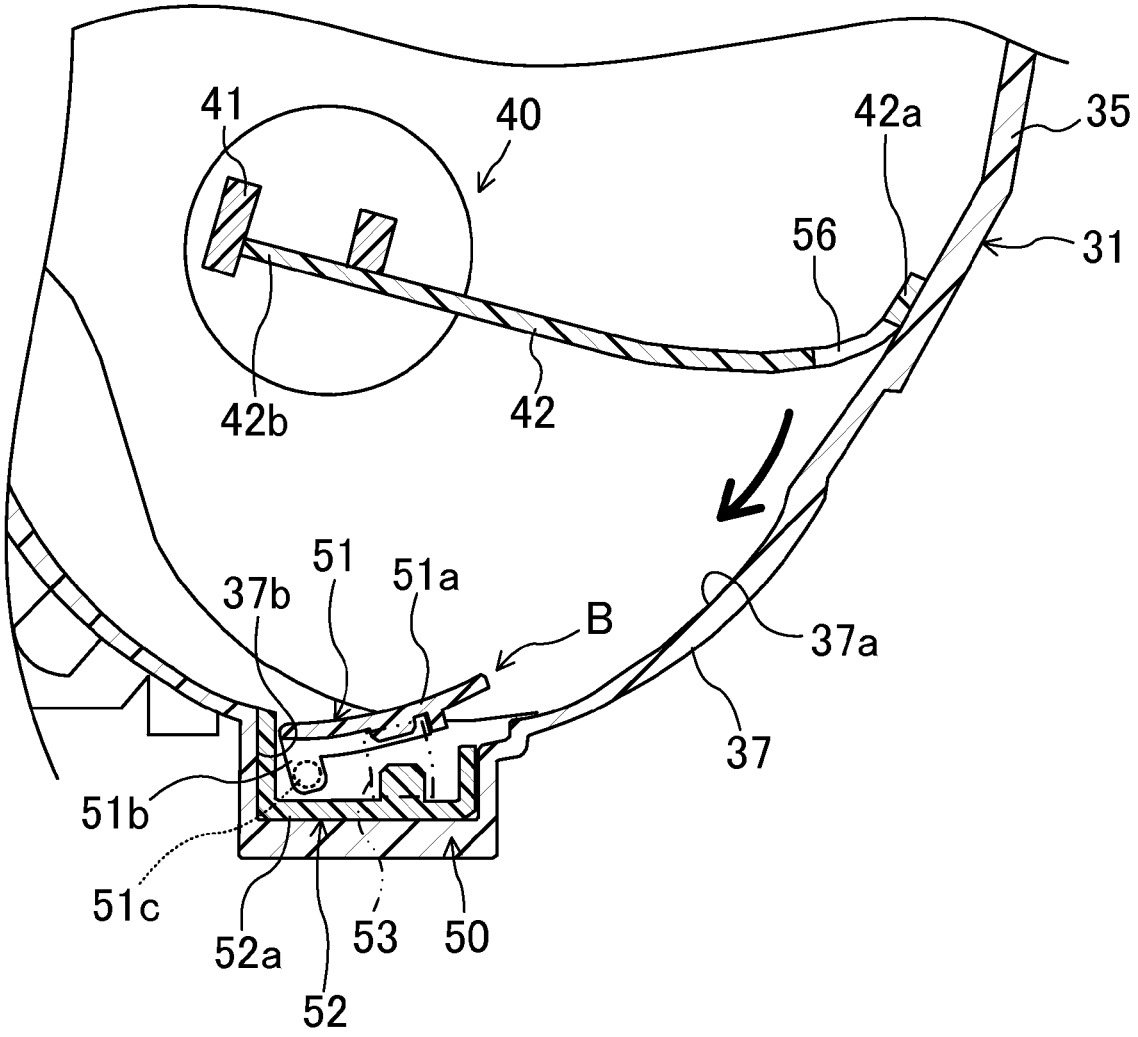
FIG. 14 is a sectional view showing the actuated stopper mechanism and the stirring sheet moving toward the stopper mechanism.
Figure 15:
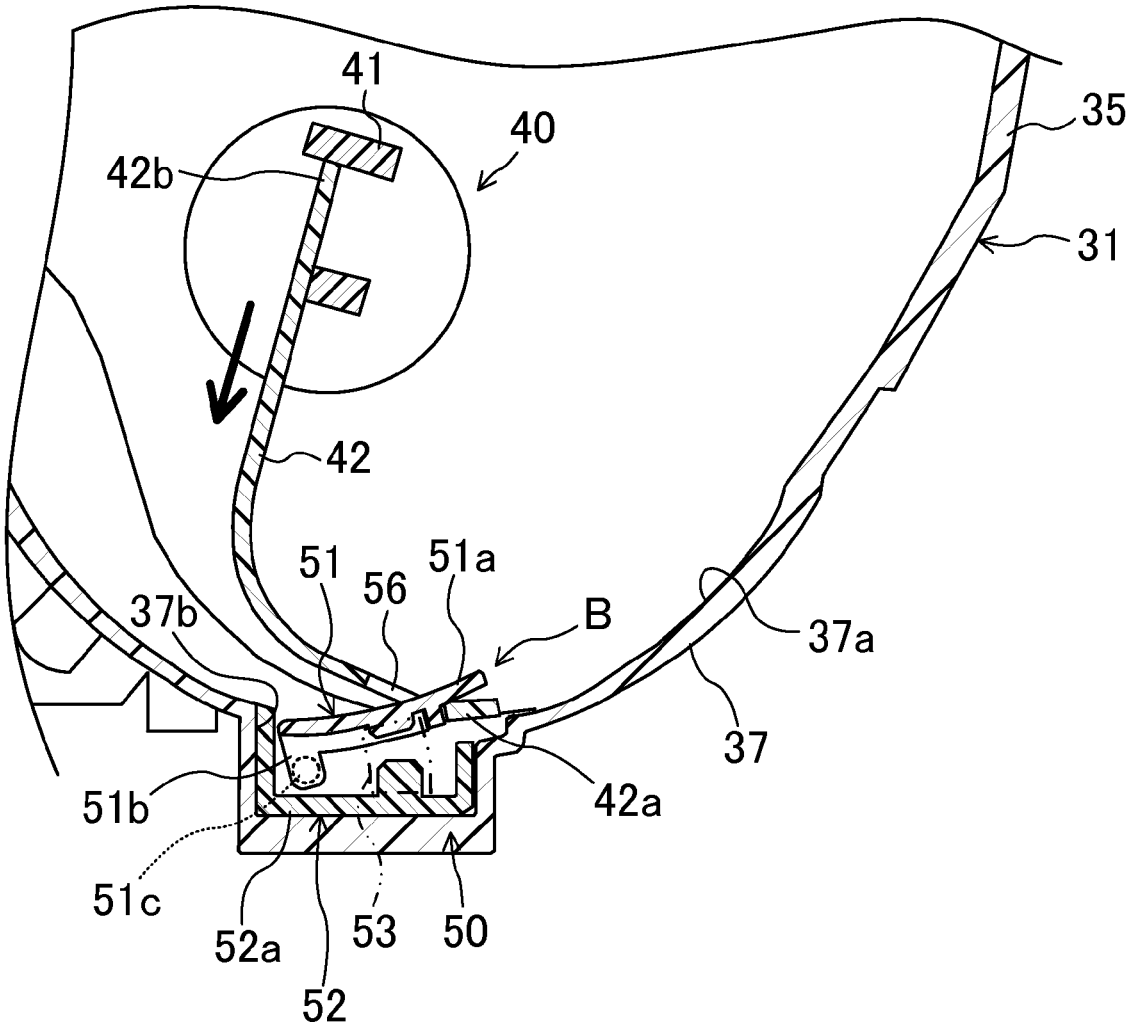
FIG. 15 is a sectional view showing the stirring sheet whose engaging portion engages with the movable member of the stopper mechanism.

FIGS. 13 to 15 illustrate the relationship between the actuated stopper mechanism 50 and the stirring sheet 42.

The stirring sheet 42 includes an engaging portion 56 that engages with the movable member 51 moved to the protruding position B. As shown in FIGS. 5 and 13, the engaging portion 56 is preferably an opening formed in the stirring sheet 42.

The stirring sheet 42 is configured such that, if the stirring sheet 42 is moved in such a state that the engaging portion 56 engages with the movable member 51, the base end portion 42*b* of the stirring sheet 42 is detached from the shaft 41. That is to say, the tip end portion 42*a* of the stirring sheet 42 is pulled by the movable member 51 caught in the engaging portion 56, whereby the hole portions 45 (see FIG. 6) of the stirring sheet 42 are removed from the projections 44 of the shaft 41. Thus, the stirring sheet 42 is detached from the shaft 41.

Therefore, according to the present embodiment, when the amount of the toner 55 existing within the housing 31 is equal to or larger than the predetermined amount, the movable member 51 lies down so as to extend along the inner wall surface 37*a* of the bottom portion 37 of the housing 31. Thus, the movable member 51 does not hinder the stirring operation of the toner 55 performed by the stirring mechanism 40. Consequently, the toner 55 existing within the housing 31 is stirred by the stirring sheet 42 rotating together with the shaft 41 and is conveyed to the toner supply unit 32 via the screw 48.

On the other hand, when the amount of the toner 55 existing within the housing 31 is less than the predetermined amount, at least a portion of the movable member 51 protrudes from the inner wall surface 37*a* of the bottom portion 37 of the housing 31. Thus, the engaging portion 56 of the stirring sheet 42 comes into engagement with the movable member 51. Accordingly, the engaging portion 56 of the stirring sheet 42 rotating together with the shaft 41 is pulled by the movable member 51. As a consequence, the base end portion 42*b* of the stirring sheet 42 is detached from the shaft 41.

Accordingly, if the amount of the toner 55 existing within the housing 31 is less than the predetermined amount and if the toner container 21 is in a used-up state, the stirring sheet 42 is completely detached from the shaft 41. Therefore, when discarding the used-up toner container 21, it is not necessary to perform a work for separating the shaft 41 and the stirring sheet 42 from each other. Therefore, in case of discarding the used-up toner container 21, it is possible to reduce the time and effort required in discerning the component parts of the used-up toner container 21.

Since the stopper mechanism 50 is provided with the biasing member 53, the movable member 51 can be moved from the lying-down position A to the protruding position B by the biasing force of the biasing member 53. By using a compressed resilient member as the biasing member 53, it is possible for the resilient member to appropriately realize the biasing member 53.

Since the engaging portion 56 is an opening formed in the stirring sheet 42, the opening of the stirring sheet 42 can be brought into engagement with the movable member 51 moved to the protruding position B. Inasmuch as the engaging portion 56 of the stirring sheet 42 can be formed by a simple configuration, i.e., an opening, it is possible to reliably bring the engaging portion 56 of the stirring sheet 42 into engagement with the movable member 51 while suppressing an increase in the manufacturing cost.

The laser printer 1 according to the present embodiment is provided with the aforementioned toner container 21. When the toner container 21 is used up, the stirring sheet 42 and the shaft 41 are kept separated from each other. Therefore, even in case of discarding the image forming apparatus, it is possible to reduce the time and effort required in discerning the component parts of the used-up toner container 21.

In the embodiment described above, the engaging portion 56 of the stirring sheet 42 is configured by an opening formed in the stirring sheet 42. However, the configuration of the engaging portion 56 is not limited thereto. The engaging portion 56 may be any other structure that can engage with the movable member 51.

In the aforementioned embodiment, description has been made on an instance where the stopper mechanism 50 is installed. However, the present disclosure is not limited thereto. It may be possible to employ a configuration in which a movable member capable of moving between a lying-down position and a protruding position is installed. For example, it may be possible to adopt a configuration in which a detector for detecting the amount of the toner existing within the housing 31 and an actuator for moving a movable member based on the detection result of the detector are installed.

In the present embodiment, the laser printer 1 has been described as one example of the image forming apparatus. However, the image forming apparatus is not limited to the laser printer 1. The image forming apparatus may be, e.g., a copier, a scanner, a multifunction peripheral or other image forming apparatus.

What is claimed is:

1. A toner container, comprising:

a housing configured to retain a toner;

a toner supply unit installed in the housing and configured to supply the toner to the outside;

a stirring mechanism configured to stir the toner within the housing such that the toner is conveyed to the toner supply unit, the stirring mechanism including a shaft rotationally driven within the housing and a stirring sheet having a base end portion removably mounted to the shaft and a tip end portion configured to move while making contact with at least an inner wall surface of a bottom portion of the housing during rotation of the shaft; and a movable member installed in the bottom portion of the housing, the movable member configured such that, if an amount of the toner existing within the housing is equal to or larger than a predetermined amount, the movable member lies down in a lying-down position where the movable member extends along the inner wall surface of the bottom portion of the housing and, if the amount of the toner existing within the housing is less than the predetermined amount, the movable member moves from the lying-down position to a protruding position where at least a portion of the movable member protrudes from the inner wall surface of the bottom portion of the housing, wherein the stirring sheet includes an engaging portion that engages with the movable member moved to the protruding position, the engaging portion being an opening formed in the stirring sheet, the stirring sheet configured such that, if the stirring sheet moves in a state that the engaging portion engages with the movable member, the base end portion of the stirring sheet is detached from the shaft.

2. The toner container of claim 1, further comprising:

a biasing member installed in the bottom portion of the housing and configured to bias the movable member such that at least a portion of the movable member protrudes from the inner wall surface of the bottom portion of the housing.

3. The toner container of claim 2, wherein the biasing member is a compressed resilient member.

4. An image forming apparatus provided with the toner container of claim 1.

* * * * *